US009917397B2

(12) United States Patent
Taguchi et al.

(10) Patent No.: US 9,917,397 B2
(45) Date of Patent: Mar. 13, 2018

(54) CONNECTOR AND CONNECTOR DEVICE

(71) Applicant: Panasonic Intellectual Property Management Co., Ltd., Osaka (JP)

(72) Inventors: Hidetaka Taguchi, Mie (JP); Kenji Okura, Mie (JP); Mitsuru Iida, Mie (JP); Chikara Ito, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/115,308

(22) PCT Filed: Jan. 28, 2015

(86) PCT No.: PCT/JP2015/000359
§ 371 (c)(1),
(2) Date: Jul. 29, 2016

(87) PCT Pub. No.: WO2015/115093
PCT Pub. Date: Aug. 6, 2015

(65) Prior Publication Data

US 2017/0005434 A1 Jan. 5, 2017

(30) Foreign Application Priority Data

Jan. 31, 2014 (JP) ..... 2014-016847
Apr. 18, 2014 (JP) ..... 2014-086753

(51) Int. Cl.
*H01R 13/627* (2006.01)
*H01R 13/533* (2006.01)
(Continued)

(52) U.S. Cl.
CPC ..... *H01R 13/533* (2013.01); *H01R 4/185* (2013.01); *H01R 12/75* (2013.01);
(Continued)

(58) Field of Classification Search
CPC ..... H01R 13/533; H01R 4/185; H01R 13/62; H01R 13/6272
(Continued)

(56) References Cited

U.S. PATENT DOCUMENTS 4,880,401 A * 11/1989 Shima ..... H01R 13/187 439/746
4,900,271 A * 2/1990 Colleran ..... H01R 13/113 439/275
(Continued)

FOREIGN PATENT DOCUMENTS

JP S57-072572 U 5/1982
JP S57-076380 U 5/1982
(Continued)

OTHER PUBLICATIONS

International Search Report issued in Application No. PCT/JP2015/000359 dated Apr. 28, 2015, with Entglish translation.

*Primary Examiner* — Abdullah Riyami
*Assistant Examiner* — Nader Alhawamdeh
(74) *Attorney, Agent, or Firm* — McDermott Will & Emery LLP

(57) ABSTRACT

A connector includes a contact in an elongated shape that is electrically conductive, and a housing that has an internal space is formed. The contact includes a contact portion, a connection portion, a fixing portion, and a protruding portion. The contact portion is to be electrically connected to an electrically conductive member when the contact is housed in the housing. The connection portion is electrically connected to a core wire of an electrical wire. The fixing portion is provided on a side opposite to the contact portion relative to the connection portion, and fixes a covering of the electrical wire. The protruding portion is provided on an end portion side of the fixing portion opposite to the connection
(Continued)

portion so as to protrude. The protruding portion reduces the amount of movement of the contact inside the internal space of the housing.

20 Claims, 13 Drawing Sheets

(51) Int. Cl.

| | |
|---|---|
| ***H01R 12/75*** | (2011.01) |
| ***H01R 13/432*** | (2006.01) |
| ***H01R 24/60*** | (2011.01) |
| ***H01R 4/18*** | (2006.01) |
| ***H01R 13/422*** | (2006.01) |
| *H01R 13/639* | (2006.01) |

(52) U.S. Cl.
CPC ..... *H01R 13/4223* (2013.01); *H01R 13/432* (2013.01); *H01R 13/6272* (2013.01); *H01R 24/60* (2013.01); *H01R 13/639* (2013.01); *H01R 2201/26* (2013.01)

(58) Field of Classification Search
USPC ..... 439/752.5, 733.1, 751, 357
See application file for complete search history.

(56) References Cited

U.S. PATENT DOCUMENTS

| | | | | |
|---|---|---|---|---|
| 5,338,219 | A * | 8/1994 | Hiramoto | H01R 13/6272 439/350 |
| 5,443,592 | A * | 8/1995 | Ittah | H01R 13/113 439/839 |
| 5,573,430 | A | 11/1996 | Hatagishi | |
| 5,575,684 | A * | 11/1996 | Uchida | H01R 13/4223 439/595 |
| 5,769,650 | A * | 6/1998 | Aoyama | H01R 13/4365 439/189 |
| 5,797,773 | A | 8/1998 | Kobayashi | |
| 5,851,128 | A | 12/1998 | Nakata et al. | |
| 7,249,983 | B2 * | 7/2007 | Meyer | H01R 4/185 439/748 |
| 7,635,286 | B1 * | 12/2009 | Morello | H01R 13/055 439/752.5 |
| 2002/0098737 | A1 | 7/2002 | Koide et al. | |
| 2008/0070446 | A1 * | 3/2008 | Lauermann | H01R 4/185 439/626 |
| 2011/0014820 | A1 | 1/2011 | Ito | |
| 2015/0162692 | A1 * | 6/2015 | Jones | H01R 13/46 439/607.01 |
| 2015/0180166 | A1 * | 6/2015 | Wu | H01R 13/113 439/485 |
| 2015/0214658 | A1 * | 7/2015 | Nishiyama | H01R 24/76 439/357 |
| 2015/0380863 | A1 * | 12/2015 | Uchida | H01R 4/185 439/587 |

FOREIGN PATENT DOCUMENTS

| | | | |
|---|---|---|---|
| JP | 62-022381 | A | 1/1987 |
| JP | H06-223665 | A | 8/1994 |
| JP | H07-282883 | A | 10/1995 |
| JP | H08-064263 | A | 3/1996 |
| JP | H08-195242 | A | 7/1996 |
| JP | H08-213091 | A | 8/1996 |
| JP | H09-245871 | A | 9/1997 |
| JP | 2002-198117 | A | 7/2002 |
| JP | 2006-100234 | A | 4/2006 |
| JP | 2009-211995 | A | 9/2009 |
| JP | 2013-030381 | A | 2/2013 |
| JP | 2013-258067 | A | 12/2013 |
| JP | 2013258067 | A * | 12/2013 |

* cited by examiner

CONNECTOR AND CONNECTOR DEVICE

RELATED APPLICATIONS

This application is the U.S. National Phase under 35 U.S.C. §371 of International Application No. PCT/JP2015/000359, filed on Jan. 28, 2015, which in turn claims the benefit of Japanese Application No. 2014-016847, filed on Jan. 31, 2014, and Japanese Application No, 2014-086753, filed Apr. 18, 2014, the disclosures of which are incorporated by reference herein.

TECHNICAL FIELD

This invention, in general, relates to connectors and connector devices, and specifically relates to a connector to be used for connecting an electrical wire and a board and a connector device including this connector.

BACKGROUND ART

Heretofore, connector devices to be used for connecting an electrical wire and aboard are known. A contact is attached to a tip of the electrical wire. A conventional connector device includes a plug connector in which the contact is inserted into a housing, and a receptacle connector that is to be mounted to the board.

A contact to be used for such a connector device is disclosed in JP H06-223665 A (hereinafter referred to as "Document 1"), for example. A plug connector in a state in which the contact attached to an electrical wire is inserted into a housing is inserted into a receptacle connector, and as a result, the contact in the plug connector is electrically connected to a post in the receptacle connector. Accordingly, a core wire of the electrical wire attached to the contact is electrically connected to an electrically conductive member that is connected to the post.

However, with the conventional connector, in the case where vibration is applied to at least one of the plug connector and the electrical wire in a state in which the plug connector is coupled to the receptacle connector, the contact attached to the electrical wire vibrates. That is, in the conventional connector, the contact vibrates in a state in which a contact portion of the contact is in contact with the post. Therefore, there is a problem in that wear of the contact portion occurs in the conventional connector, in particular, in the case where the connector device is mounted on a car, the vibration that occurs in the contact is frequent and large, and as a result, the possibility of the contact portion of the contact being worn away becomes very high.

Note that, a connector in which a fitting state with a partner member is held by a lever is known as a conventional connector (refer to JP 2012-38570 A (hereinafter referred to as "Document 2"), for example).

A female connector (connector) described in Document 2 includes a lock arm (lever provided with an engagement protrusion portion. The lock arm is formed such that the front end portion thereof is connected to a housing of the female connector and the rear end portion thereof is free.

When the female connector including such a lock arm starts to be inserted into the male connector, the lock arm is bent due to a pushing force generated by a user or by the housing of the male connector. Furthermore, when the female connector has been inserted into the male connector, the engagement protrusion portion is engaged with a projection portion of the male connector. Accordingly, the female connector described in Document 2 is fixed to the male connector.

Incidentally, because the rear end portion of the lock arm is free in such a connector, in the case where a hand or an object catches on the rear end portion of the lock arm, it is possible that the lock arm is turned up or an excessive force is applied to the lock arm.

Therefore, in the female connector described in Document 2, the housing is provided with a lock arm protection wall no as to cover the rear end portion of the lock arm via a space. Accordingly, the occurrence of excessive turning up of the lock arm or the lock arm being broken is reduced.

SUMMARY OF INVENTION

The present invention has been made in view of the above-described problems, and an object of the present invention is to provide a connector and a connector device in which wear of a contact portion of a contact due to vibration of the contact can be reduced.

A connector of the present invention includes: a contact in an elongated shape that is electrically conductive and is attached to an electrical wire; and a housing that has an internal space for housing the contact is formed. The electrical wire includes a core wire that is electrically conductive, and a covering that is electrically insulated and covers the core wire. The contact includes a contact portion, a connection portion, a fixing portion, and a protruding portion. The contact portion is to be electrically connected to an electrically conductive member when the contact is housed in the housing. The connection portion is electrically connected to the core wire of the electrical wire. The fixing portion is provided on a side opposite to the contact portion relative to the connection portion in a longitudinal direction of the contact, and fixes the covering of the electrical wire. The protruding portion is provided on a side on which an end portion of the fixing portion opposite to the connection portion in the longitudinal direction is located so as to protrude. The protruding portion is configured to reduce an amount of movement of the contact inside the internal space in at least a predetermined direction that intersects the longitudinal direction.

In the connector, the protruding portion preferably includes a base portion that is provided in the end portion of the fixing portion toward a side opposite to the connection portion in the longitudinal direction, and two extending portions that are respectively provided on two sides of the base portion so as to extend in a direction that intersects the longitudinal direction. The two sides of the base portion are along the longitudinal direction.

In the connector, it is preferable that two inner surfaces of the internal space respectively have two recess to which the two extending portions are respectively introduced when the contact is housed in the housing.

In the connector, the two extending portions preferably have two tips that oppose each other.

In the connector, the protruding portion preferably further includes projection portions respectively provided on outer surfaces of the two extending portions.

In the connector, the two extending portions preferably have tips that are brought into contact with an inner surface of the internal space.

In the connector, each of the two extending portions is preferably formed in a tapered shape such that a length from the base portion to a tip decreases toward the fixing portion on a side on which the fixing portion is located in the longitudinal direction.

In the connector, the base portion is preferably formed such that a shape of a cross section whose normal direction is the longitudinal direction is arc-like.

In the connector, the shape of the cross section of the base portion is preferably arc-like along an outer periphery of the electrical wire.

In the connector, the base portion is preferably provided so as to protrude from a central portion of the fixing portion in the longitudinal direction.

A connector device of the present invention includes the connector and a receptacle connector that includes the electrically conductive member and to which the connector is to be coupled.

It is preferable that the connector further includes a lever in the housing, the housing is configured so as to be inserted into a partner housing of a partner member that is to be fitted to the connector from a first side in a first direction, the lever is provided in the housing along the first direction, the lever includes a lever body that includes a support portion fixed to the housing and is configured to be bendable along a second direction that is orthogonal to the first direction, a lock portion that is provided in the lever body and is configured to be lockable to a locked portion of the partner housing when the housing is inserted into the partner housing, and an operation portion that is provided on an outer surface of the lever body and accepts an operation for releasing locking between the lock portion and the locked portion, and the housing includes a housing body, and a regulating portion that is provided on an outer surface of the housing body and regulates the operation to be performed on the operation portion, and the regulating portion is provided in the housing body so as to be located closer on a second side, opposite to the first side, than the operation portion in the first direction.

The connector of the present invention is a connector to be fitted to a partner member. The connector includes a housing configured to be inserted into a partner housing of the partner member from a first side in a first direction; and a lever that is provided in the housing alone the first direction. The lever includes a lever body that includes a support portion fixed to the housing and is configured to be bendable along a second direction that is orthogonal to the first direction, a lock portion that is provided in the lever body and is configured to be lockable to a locked portion of the partner housing when the housing is inserted into the partner housing, and an operation portion that is provided on an outer surface of the lever body and accepts an operation for releasing locking between the lock portion and the locked portion. The housing includes a housing body, and a regulating portion that is provided on an outer surface of the housing body and regulates the operation to be performed on the operation portion. The regulating portion is provided on the housing body so as to be located closer on a second side, opposite to the first side, than the operation portion in the first direction.

In the connector, it is preferable that the operation portion is located closer on the second side than the support portion in the first direction, and the lock portion is located between the support portion and the operation portion in the first direction.

In the connector, it is preferable that the lock portion is provided so as to protrude from the lever body in the second direction, and the regulating portion protrudes from the outer surface of the housing body in the second direction.

In the connector, an end surface of the operation portion in the second direction is preferably located so as to exceed, in the second direction, an end surface of the regulating portion in the second direction.

In the connector, the end surface of the operation portion in the second direction and the end surface of the regulating portion in the second direction are preferably located on the same plane.

In the connector, the regulating portion is preferably longer than the operation portion in a third direction that is orthogonal to the first direction and the second direction.

It is preferable that the connector further includes a plurality of contacts that are electrically conductive and are each attached to an electrical wire. The housing body has a plurality of contact insertion holes to which the plurality of contacts are respectively inserted. The plurality of contact insertion holes are provided in the housing body side by side in a third direction that is orthogonal to the first direction and the second direction. The lever and the regulating portion are provided side by side with the plurality of contact insertion holes in the third direction.

The connector device of the present invention includes the connector and the partner member to which the connector is to be fitted.

According to the present invention, wear of the contact portion of the contact due to vibration of the contact can be reduced.

BRIEF DESCRIPTION OF DRAWINGS

A preferable embodiment according to the present invention will be described in detail. Other features and advantages of the present invention will become apparent from the following detailed description with reference to the attached drawings.

DESCRIPTION OF EMBODIMENTS

In a connector (plug connector according to the following embodiment, a contact includes a protruding portion on a side opposite to a connection portion relative to a fixing portion in a longitudinal direction of the contact, and the protruding portion reduces the positional displacement of a contact portion of the contact inside a housing.

Hereinafter, details of the plug connector and a connector device according to the present embodiment will be described with reference to the drawings.

Figure 2:
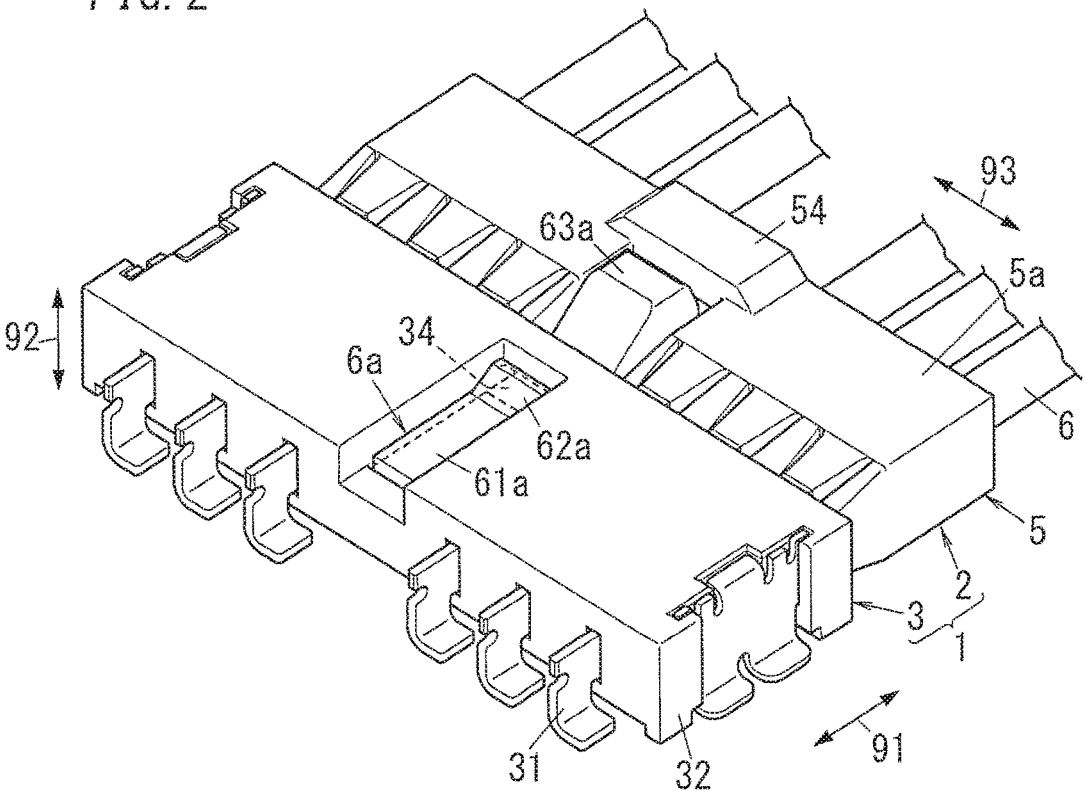
FIG. 2 is a perspective view of a connector device according to the embodiment.

A connector device 1 according to the present embodiment includes a plug connector (connector) 2 and a receptacle connector (partner member) 3 to which the plug connector 2 is to be coupled (fitted), as shown in FIG. 2. The connector device 1 is used for connecting an electrical wire 6 and a board 72 (refer to FIG. 8) in a vehicle such as a car, for example. The connector device 1 is a so-called wire-to-board connector device. Note that the application of the connector device 1 is not limited to vehicles, and the connector device 1 may be used for applications other than vehicles.

In the present embodiment, the plug connector 2, the receptacle connector 3, and a plurality of contacts 4 (a plurality of contacts 4*a*) will be described while defining directions 91 to 93 as follows.

Figure 5:
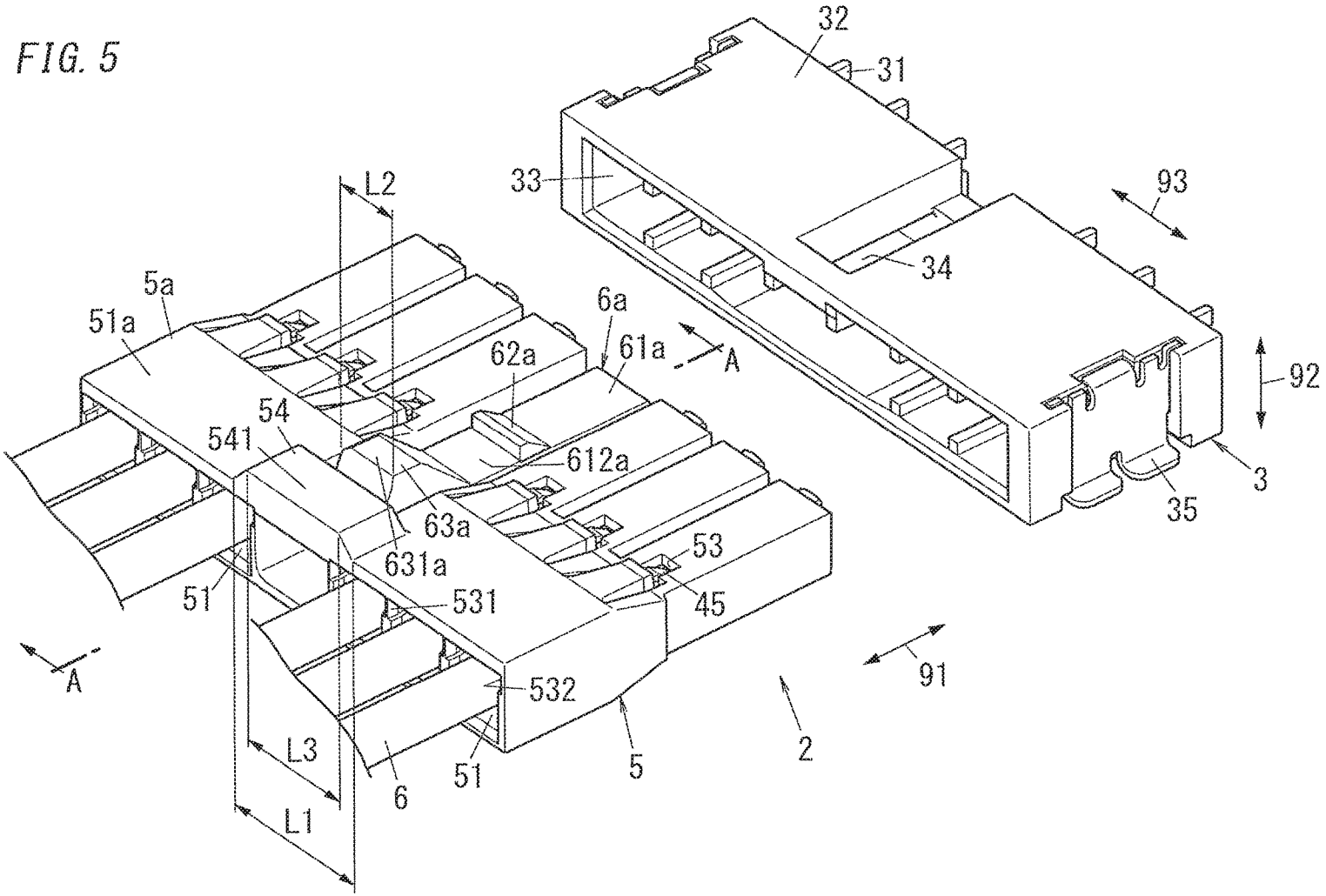
FIG. 5 is a perspective view of a plug connector and a receptacle connector according to the embodiment.

In the plug connector 2, the direction 91 is a direction in which the contacts 4 are respectively inserted into a plurality of internal spaces 51 of a housing 5, as shown in FIG. 5. The direction 93 is a direction in which the plurality of internal spaces 51 of the housing 5 are arranged. The direction 92 is a direction orthogonal to the direction in which the contacts 4 are respectively inserted into the plurality of internal spaces 51 of the housing 5 and the direction in which the plurality of internal spaces 51 is arranged.

In the receptacle connector 3, the direction 91 is a direction in which the housing 5 of the plug connector 2 is inserted into a housing 32. The direction 93 is a direction in which a plurality of posts 31 are lined up in the housing 32. The direction 92 is a direction orthogonal to the direction in which the housing 5 of the plug connector 2 is inserted into the housing 32 and the direction in which the plurality of posts 31 are lined up in the housing 32.

Figure 3:
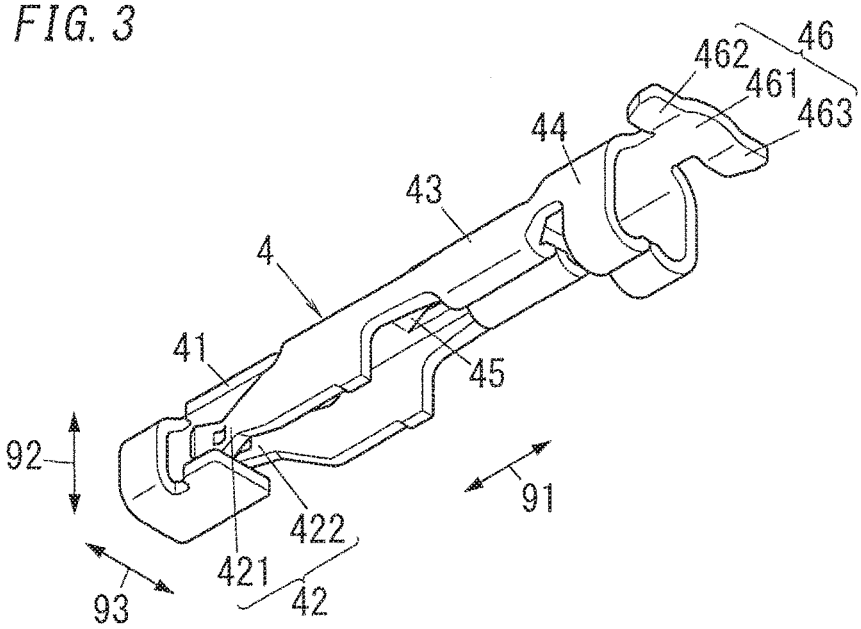
FIG. 3 is a perspective view of a contact according to the embodiment.

In each of the plurality of contacts 4 that are each formed in an elongated shape, the direction 91 is a longitudinal direction of the contact 4, as shown in FIG. 3. The direction 93 is a direction in which a first contactor 421 and a second contactor 422 oppose each other. The direction 92 is a direction orthogonal to the direction in which the first contactor 421 and the second contactor 422 oppose each other and the longitudinal direction of the contact 4. The same applies to the plurality of contacts 4*a* shown in FIG. 12.

Figure 1:
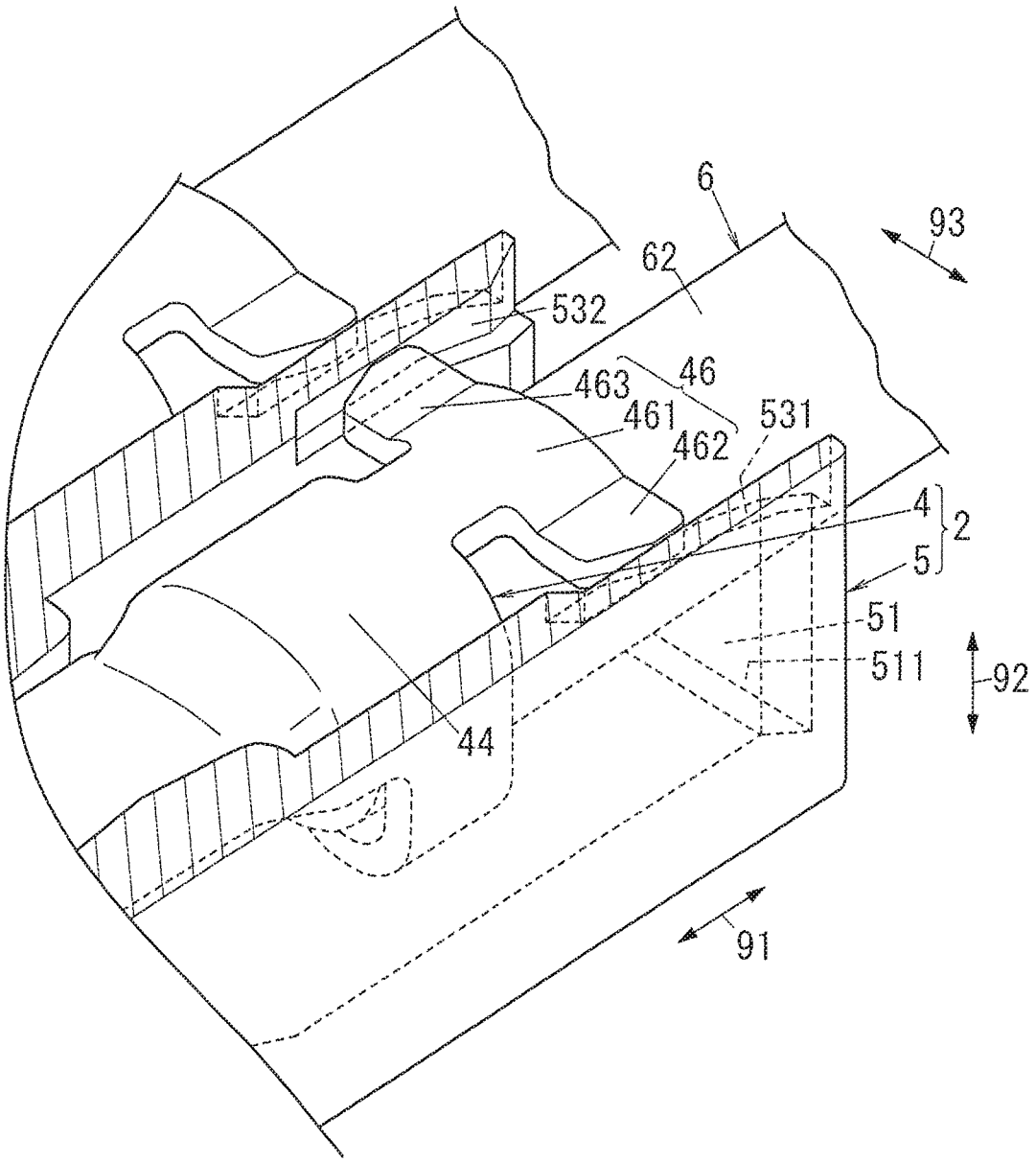
FIG. 1 is a schematic diagram illustrating main portions of a plug connector according to an embodiment.

The plug connector 2 includes the plurality of elongated contacts 4 and the electrically insulating housing 5, as shown in FIG. 1. The plug connector 2 of the present embodiment corresponds to a connector of the present invention. The plurality of internal spaces (contact insertion holes) 51 are formed in the housing 5 so as to respectively house the plurality of contacts 4.

Figure 7:
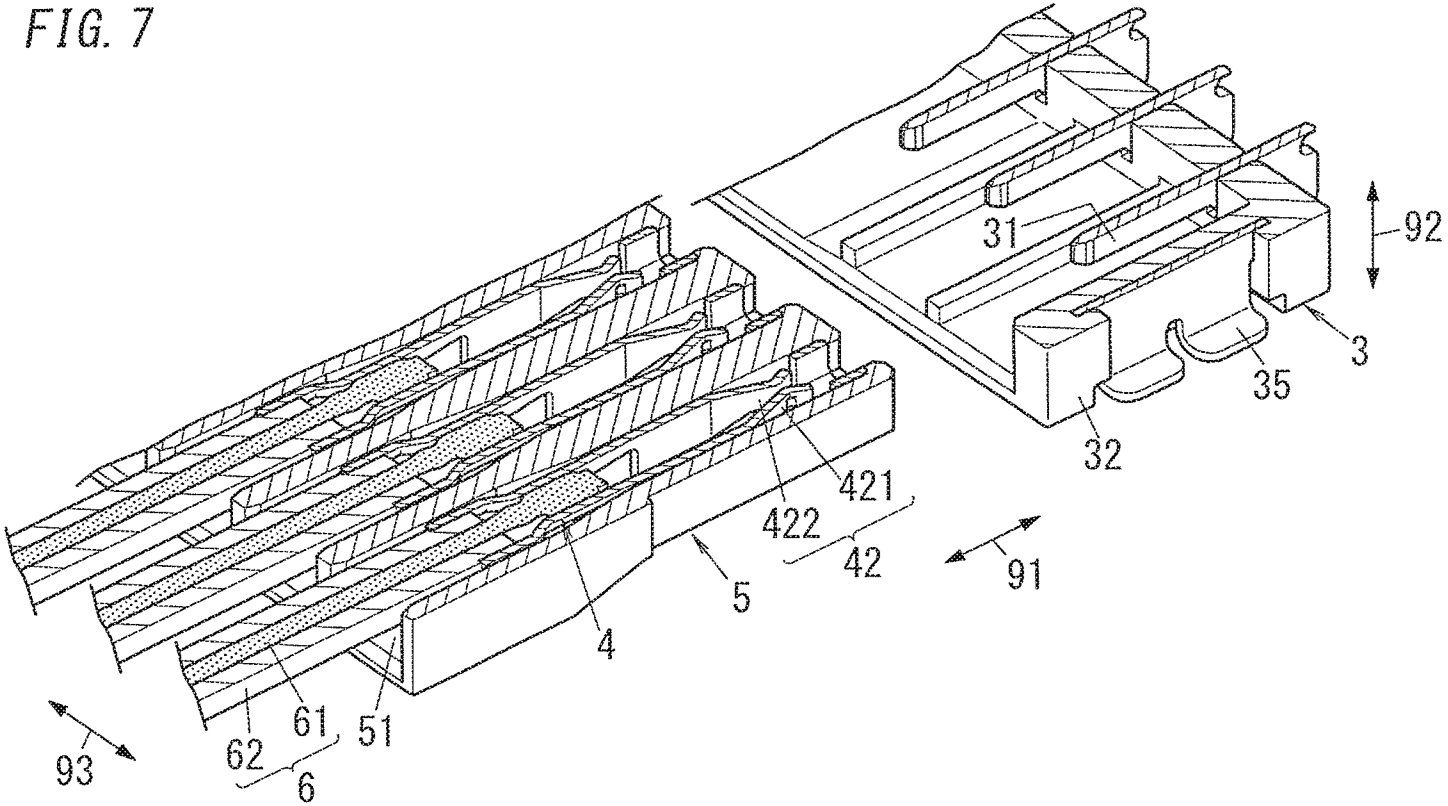
FIG. 7 is a cross-sectional view of main portions of the plug connector and receptacle connector according to the embodiment.

The electrical wire 6 includes a core wire 61 (refer to FIG. 7) and a covering 62 that covers the core wire 61. The core wire 61 is made of an electrically conductive material, and is electrically conductive. The covering 62 is made of an electrically insulating material, and is electrically insulated.

Figure 4:
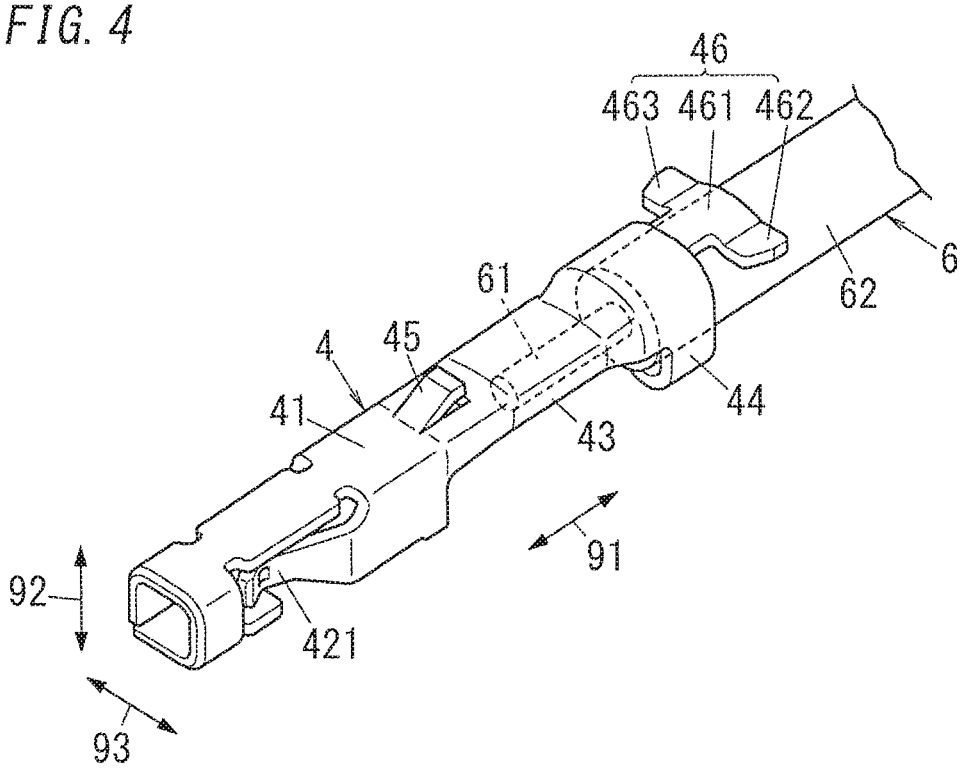
FIG. 4 is a perspective view of the contact according to the embodiment.

Subsequently, each contact 4 will be described with reference to FIGS. 3 and 4. Note that the contact 4 in a state of being attached to the electrical wire 6 is shown in FIGS. 3 and 4, and illustration of the electrical wire 6 is omitted in FIG. 3.

The contact 4 includes a base portion 41, a contact portion 42, a connection portion 43, a fixing portion 44, a fixing piece 45, and a protruding portion 46. Specifically, the contact 4 integrally includes the base portion 41, the contact portion 42, the connection portion 43, the fixing portion 44, the fixing piece 45, and the protruding portion 46 due to bending processing or the like performed on a sheet metal, for example. The contact 4 is electrically conductive, and is a member that is to be attached to the electrical wire 6. The contact 4 is formed on as to have an elongated shape.

When the plug connector 2 in which the contacts 4 are housed in the housing 5 (refer to FIG. 1) is coupled to the receptacle connector 3, the contact portion 42 of each of the contacts 4 is electrically connected to the later-described post (electrically conductive member) 31 (refer to FIG. 2). The contact portion 42 includes the first contactor 421 and the second contactor 422. The first contactor 421 and the second contactor 422 are provided so as to extend in the direction (second direction) 92 that is orthogonal to the direction (first direction) 91 from two sides of the base portion 41 extending along the direction 91.

The first contactor 421 and the second contactor 422 are arranged so as to oppose each other in the direction (third direction) 93 orthogonal to the direction 91 and the direction 92, and are bent so as to be inclined in a direction such that the first contactor 421 and the second contactor 422 approach each other toward a front side, ends thereof on a rear end side being fixed ends. That is, the first contactor 421 and the second contactor 422 are formed to be bendable in the direction 93. When the plug connector 2 in which the contacts 4 are housed in the housing 5 is coupled to the receptacle connector 3, the first contactor 421 and the second contactor 422 of each of the contacts 4 sandwich a post (electrically conductive member) 31 in the housing 5 so as to come into elastic contact with the post 31.

Two end portions of the connection portion 43 are bent so as to fix the core wire 61 of the electrical wire 6 (fixing by tightening), and thus the connection portion 43 is electrically connected to the core wire 61 of the electrical wire 6.

The fixing portion 44 is provided on a side opposite to the contact portion 42 relative to the connection portion 43 in the direction 91, which is the longitudinal direction of the contact 4. The fixing portion 44 fixes the covering 62 of the electrical wire 6. Specifically, two end portions of the fixing portion 44 are bent so as to fix the covering 62 of the electrical wire 6.

The protruding portion 46 reduces the amount of movement of the contact 4 inside the internal space 51 of the housing 5 in the direction 92, which is orthogonal to the direction 91, and in the direction 93. The protruding portion 46 is provided on an end portion side of the fixing portion 44 opposite to the connection portion 43 in the direction 91 so as to protrude therefrom. That is, the protruding portion 46 is provided so as to protrude rearward from a rear end portion of the fixing portion 44 in the direction 91. The protruding portion 46 is formed in a projection-like shape. The protruding portion 46 integrally includes a base portion 461 and a pair of extending portions 462 and 463.

The base portion 461 is provided on the end portion side of the fixing portion 44 opposite to the connection portion 43 in the direction 91 so as to extend from the fixing portion 44. That is, the base portion 461 is connected to the rear end side of the fixing portion 44 in the direction 91.

Also, the base portion 461 is formed such that a shape of a cross section whose normal direction is the direction 91 is arc-like. Specifically, the shape of the cross section of the base portion 461 is arc-like extending along an outer periphery of the electrical wire 6.

Furthermore, the base portion 461 is provided so as to protrude from a cent a portion of the fixing portion 44 in the direction 91. Accordingly, when two end portions of the fixing portion 44 are bent so that the fixing portion 44 fixes the covering 62, the position of the protruding portion 46 does not change, and therefore influence on the protruding portion 46 is small. Accordingly, the protruding portion 46 (extending portions 462 and 463) can accurately engage with later-described recesses 531 and 532 (refer to FIG. 1).

The extending portions 462 and 463, which form a pair, are provided so as to respectively extend from two sides of the base portion 461. The two sides are along the direction 91. That is, the pair of extending portions 462 and 463 is provided so as to extend from the base portion 461 along the direction 93, which is orthogonal to the direction 91. Note that it is sufficient that the extending portions 462 and 463, which form a pair, are provided so as to respectively extend from two sides of the base portion 461 in a direction that intersects the direction 91. The two sides are along the direction 91. The extending direction is not limited to the direction 93 that is orthogonal to the direction 91.

Each of the pair of extending portions 462 and 463 is formed in a tapered shape, on a fixing portion 44 side in the direction 91, such that the length from the base portion 461 to a tip thereof decreases toward the fixing portion 44. That is, each of the extending portions 462 and 463 has a front end that is formed in a tapered shape such that a width thereof decreases toward the fixing portion 44 in the direction 91. In other words, each of the extending portions 462 and 463 is formed in a tapered shape such that, when the contact 4 is inserted into the housing 5 (refer to FIG. 1), the width of a portion thereof that is to be inserted first into the internal space 51 of the housing 5 is correspondingly narrower. The width described above is the length of each of the extending portions 462 and 463 from the base portion 461 to the tip thereof in the direction 93. Accordingly, when the contact 4 is inserted into the housing 5, the extending portions 462 and 463 are unlikely to catch on the housing 5. As a result, although the total length of the contact 4 increases because of the protruding portion 46, the contact 4 can be easily inserted into the housing 5.

Next, the housing 5 will be described with reference to FIGS. 1 and 5 to 7.

The housing 5 is configured such that a front side (first side) thereof in the direction 91 is to be inserted first to the housing (partner housing) 32 of the receptacle connector 3, as shown in FIG. 5. The housing 5 is constituted by a molded article made of a synthetic resin that is electrically insulated.

The housing 5 includes a housing body 5*a*. The housing 5 is to maintain a fit state with the housing 32.

The plurality of internal spaces 51 to each of which the contact 4 is inserted are formed in the housing body 5*a*. Specifically, the plurality of internal spaces 51 are formed in the housing body 5*a* so as to be side by side in the direction (right and left direction) 93 that is orthogonal to the direction 91 and the direction (thickness direction of the housing 5) 92.

Each internal space 51 opens on front and rear surfaces of the housing 5, and the contact 4 to which the electrical wire 6 is attached is inserted into the internal space 51 from the opening in the rear surface of the housing 5. That is, each internal space 51 opens on both the front and rear surfaces (two sides in the direction 91) of the housing body 5*a*. The contact 4 to which the electrical wire 6 is attached is inserted into the internal space 51 from the opening in the rear surface of the housing body 5*a*.

Recesses 531 and 532, which form a pair, to which the extending portions 462 and 463 are respectively introduced when the contact 4 is housed in the housing 5 are respectively formed in inner surfaces (side surfaces 511 and 512, refer to FIG. 9), which form a pair, of each of the internal spaces 51, as shown in FIGS. 1 and 5. The recess 531 is formed in a groove shape such that the extending portion 462 of the protruding portion 46 is to be introduced, and the recess 532 is formed in a groove shape such that the extending portion 463 of the protruding portion 46 is to be introduced, as shown in FIG. 1. That is, the extending portion 462 of the protruding portion 46 engages with the groove-like recess 531, and the extending portion 463 of the protruding portion 46 engages with the groove-like recess 532.

Each contact 4 to which the electrical wire 6 has been connected is inserted into an internal space 51. That is, each contact 4 is inserted into an internal space 51 in a state in which the electrical wire 6 is connected thereto.

Figure 6:
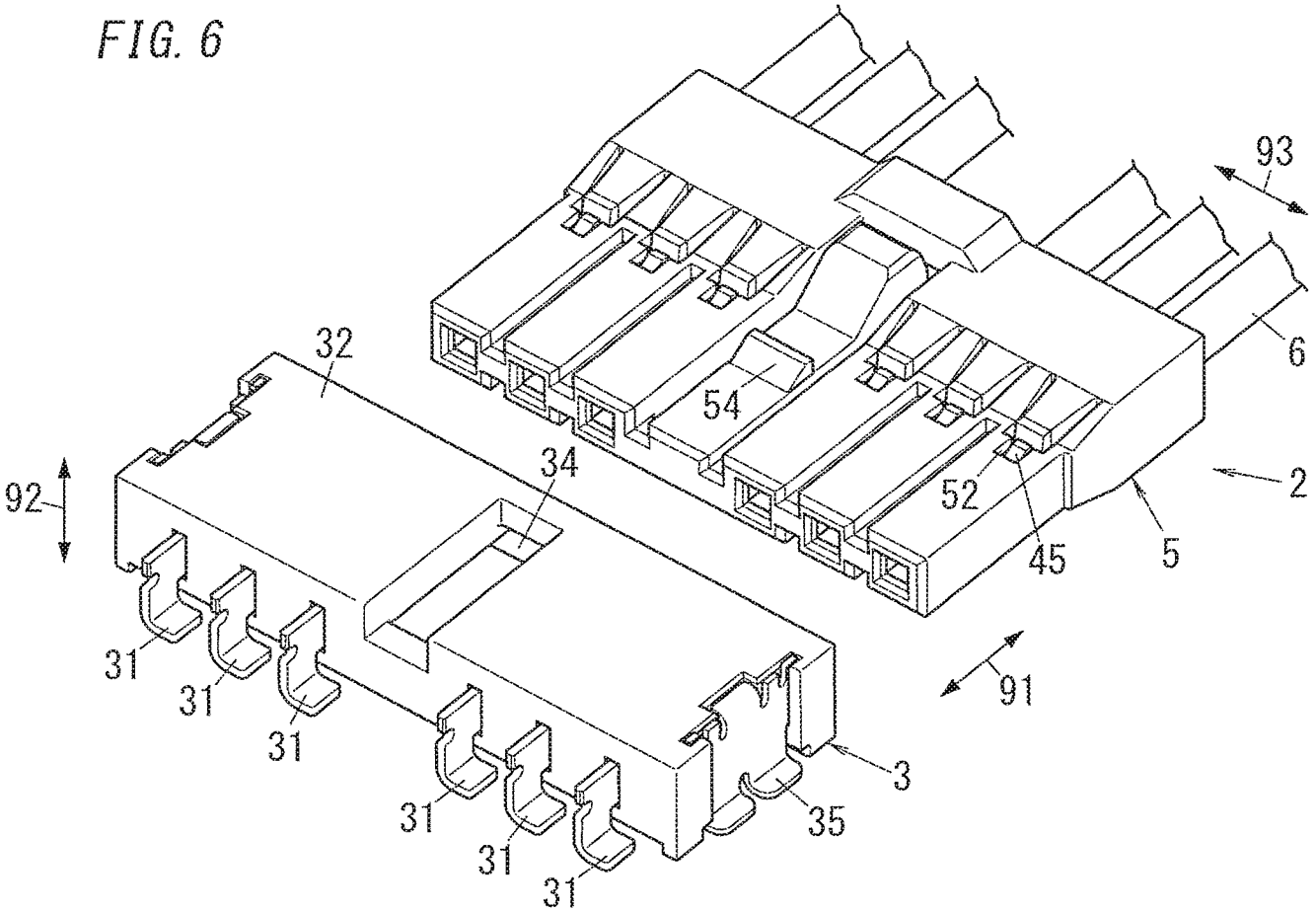
FIG. 6 is a perspective view of the plug connector and the receptacle connector according to the embodiment.

When the contact 4 is inserted to a predetermined position, the fixing piece 45 that is formed by cutting and raising a portion of the contact 4 is locked with a hole 52 in the housing 5 (housing body 5*a*), and thus the contact 4 is held in a state of being arranged in the internal space 51, as shown in FIG. 6. In a state in which the contact 4 is arranged in the internal space 51, the first contactor 421 and the second contactor 422 that are included in the contact 4 are arranged so as to oppose each other in the direction 93 (refer to FIG. 7). Accordingly, when the plug connector 2 is inserted into the receptacle connector 3 in a state in which each contact 4 is arranged in an internal space 51, the first contactor 421 and the second contactor 422 come into contact with the corresponding post 31. As a result, the post 31 is electrically connected to the core wire 61 of the electrical wire 6 (refer to FIG. 7).

Figure 9:
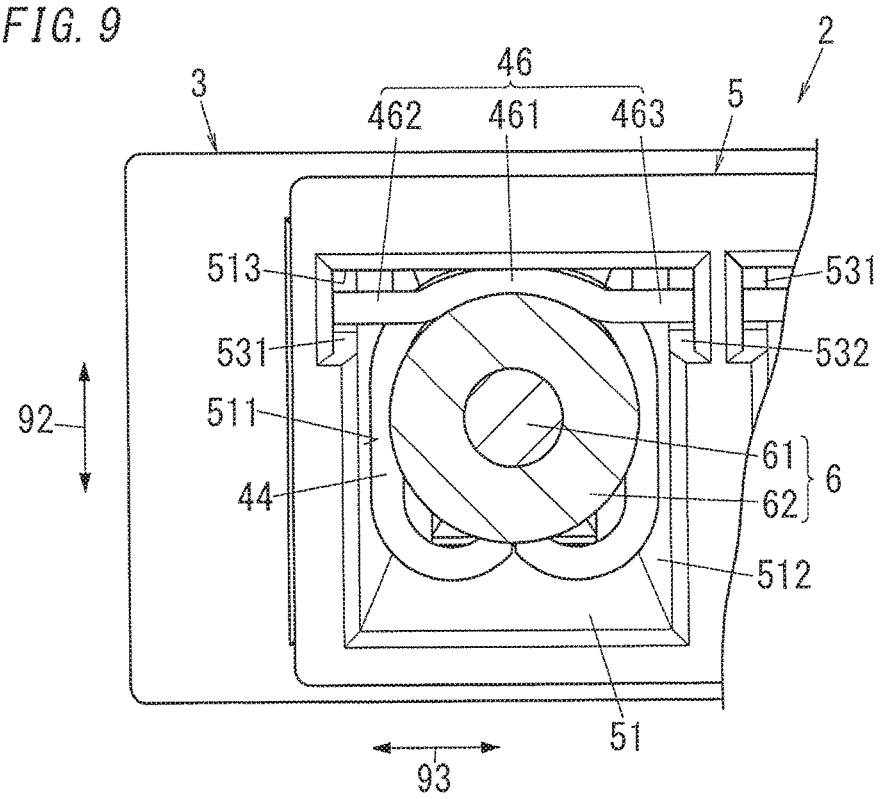
FIG. 9 is a diagram for describing a state in which the contact is housed in a housing in the plug connector according to the embodiment.

In such a plug connector 2, the base portion 461 of the protruding portion 46 of the contact 4 comes into contact with an upper surface 513 of the internal space 51, as shown in FIG. 9. The extending portions 462 and 463, which form a pair, respectively engage with the recesses 531 and 532 of the housing 5, and the tips of the pair of extending portions 462 and 463 respectively come into contact with the side surfaces 511 and 512, which are the inner surfaces of the internal space 51. Accordingly, when the electrical wire 6 vibrates in the direction 92, or vibrates in the direction 93, the amount of movement of the contact 4 inside the internal space 51 of the housing 5 can be reduced. As a result, the positional displacement of the contact portion 42 (refer to FIG. 3) of the contact 4 can be reduced.

Incidentally, in the conventional connector (female connector) described in Document 2, a protection mechanism (lock arm protection wall) for protecting the lever (lock arm) is provided in the housing so as to cover a rear end portion of the lever via a space. Therefore, there is a problem in that the conventional connector increases in size in a direction that is orthogonal to an insertion and removal direction of the connector to and from a partner member (male connector), that is, in a thickness direction of the housing, compared with a connector in which the protection mechanism is not provided in the housing.

Thus, the plug connector 2 of the present embodiment includes a lever (latch lock lever 6*a* along with the housing 5, as shown in FIG. 5, in order to solve the above-described problem. Accordingly, with the plug connector 2 of the present embodiment, the overall size of the connector can be reduced while protecting the lever 6*a*.

The lever 6*a* is provided in the housing 5 (housing body 5*a*) along the direction 91.

The lever 6*a* includes a lever body 61*a*, a lock portion (latch lock portion) 62*a*, and an operation portion 63*a*. Specifically, the lever 6*a* is made of a synthetic resin, for example, so as to integrally include the lever body 61*a*, the lock portion 62*a*, and the operation portion 63*a*. Note that the lever 6*a* may include the lever body 61*a* and the lock portion 62*a* as separate members. Also, the lever 6*a* may include the lever body 61*a* and the operation portion 63*a* as separate members.

Figure 13:
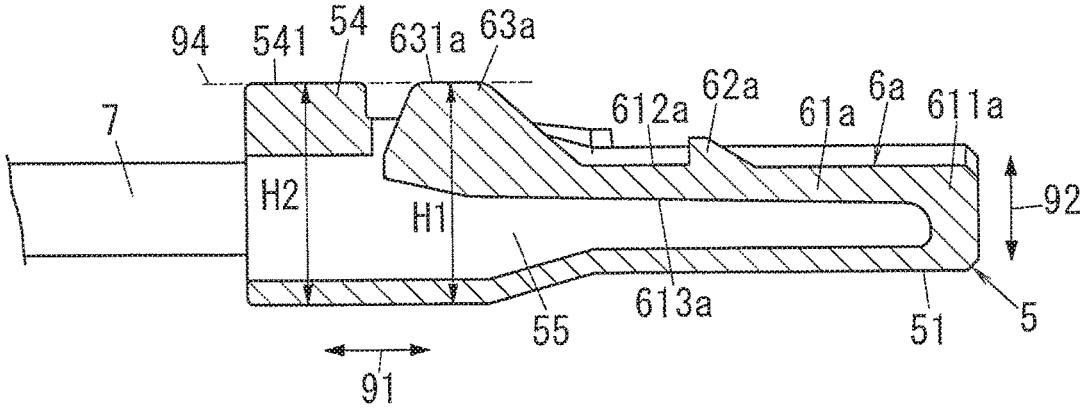
FIG. 13 is across-sectional view of a plug connector according another example of the embodiment.

The lever body 61*a* includes a support portion 611*a* that is fixed to the housing 5 (housing body 5*a*), as shown in FIG. 13, and is configured so as to be bendable along the direction 92. Specifically, the lever body 61*a* is formed in a plate-like shape, and is provided in the housing body 5*a* such that the longitudinal direction thereof is the direction 91. The lever body 61*a* includes the support portion 611*a* on the front side (first side) in the direction 91. Note that FIG. 13 is a cross-sectional view of a plug connector 2 according to another example of the present embodiment taken along line A-A in FIG. 5. The plug connector 2 in FIG. 13 has a configuration similar to that of the plug connector 2 of the present embodiment except for the positional relationship (described later) between end surfaces 631*a* and 541 of the operation portion 63*a* and a regulating portion 54 in the direction 92.

The lock portion 62*a* is provided in the lever body 61*a*. The lock portion 62*a* is configured so as to be lockable to a locked portion 34 of the housing 32, when the housing 5 is inserted into the housing 32 of the receptacle connector 3, as shown in FIG. 5.

The operation portion 63*a* is provided on an outer surface 612*a* of the lever body 61*a*. The operation portion 63*a* is configured to accept an operation for releasing locking between the lock portion 62*a* and the locked portion 34. Note that the operation portion 63*a* may accept not only the operation for releasing locking between the lock portion 62*a* and the locked portion 34, but also an operation for performing locking between the lock portion 62*a* and the locked portion 34. That is, the operation portion 63*a* accepts an operation for switching of locking and releasing locking between the lock portion 62*a* and the locked portion 34.

A space 55 (refer to FIG. 13) is formed on art inner surface 613*a* side of the lever body 61*a*. Since the space 55 is formed under the lever 6*a*, when the operation portion 63*a* is pushed down from above, the lever 6*a* bends downward. That is, the lever 6*a* bends in the direction 92.

In such a plug connector 2, the housing 5 further includes the regulating portion 54, as shown in FIG. 5.

The regulating portion 54 is provided on an outer surface 51*a* of the housing body 5*a*. The regulating portion 54 is configured to regulate an operation performed on the operation portion 63*a*.

Also, the regulating portion 54 is provided in the housing body 5*a* so as to be located on a rear side (second side) of the housing body 5*a* relative to the operation portion 63*a* of the lever 6*a* in the direction 91. In other words, the operation portion 63*a* is located on a front side (first side) relative to the regulating portion 54 in the direction 91. Accordingly, the regulating portion 54 and the operation portion 63*a* are arranged so as to be shifted in the direction 91. As a result, the regulating portion 54 regulates an operation performed on the operation portion 63*a* from the rear side (second side) in the direction 91.

Here, the operation portion 63*a* is located on the rear side (second side) relative to the support portion 611*a* (refer to FIG. 13) in the direction 91, as shown in FIG. 5. The lock portion 62*a* is preferably located between the support portion 611*a* and the operation portion 63*a* in the direction 91.

Also, as in the present embodiment, the lock portion 62*a* is provided so as to protrude from the lever body 61*a* in the direction 92, and the regulating portion 54 is preferably a protruding portion that protrudes from the outer surface 51*a* of the housing body 5*a* in the direction 92.

Furthermore, as shown in FIG. 5, the end surface 631*a* of the operation portion 63*a* in the direction 92 is preferably located so as to exceed, in the direction 92, the end surface 541 of the regulating portion 54 in the direction 92. That is, a height of the upper surface of the operation portion 63*a* from a bottom surface of the housing 5 is larger than a height of the regulating portion 54 from the bottom surface of the housing 5.

On the other hand, as shown in FIG. 13, the end surfaces 631*a* and 541 of the operation portion 63*a* and the regulating portion 54 in the direction 92 may be located on the same plane (on an imaginary plane 94). That is, a height H1 of the upper surface of the operation portion 63*a* from the bottom surface of the housing 5 is equal to a height H2 of the regulating portion 54 from the bottom surface of the housing 5. The imaginary plane 94 is a plane extending in a direction orthogonal to the direction 92.

Also, the regulating portion 54 is preferably longer than the operation portion 63*a* in the direction 93 that is orthogonal to the direction 91 and the direction 92, as shown in FIG. 5. That is, a length L1 of the regulating portion 54 is larger than a length L2 of the operation portion 63*a*. In the present embodiment, a length L3 of the upper surface of the regulating portion 54 is also larger than the length L2 of the operation portion 63*a*.

Furthermore, the lever 6*a* and the regulating portion 54 are preferably provided so as) be side by side with the plurality of internal spaces (contact insertion holes) 51 in the direction 93.

The present embodiment enables reduction of the overall size while protecting the lever.

Next, the receptacle connector 3 will be described with reference to FIGS. 5 and 6.

The receptacle connector 3 includes the plurality of (six, in the illustrated example) posts (electrically conductive members) 31, the housing 32 that supports the plurality of posts 31, and a pair of holding members 35 for maintaining strength and bonding strength of the housing 32, as shown in FIG. 6. The plug connector 2 is detachably connected to the receptacle connector 3. Also, a hole serving as the locked portion 34 is formed in the housing 32.

Each post 31 is electrically connected to the first contactor 421 and the second contactor 422 (refer to FIG. 7) of the contact 4 when the plug connector 2 is coupled to the receptacle connector 3.

Figure 16:
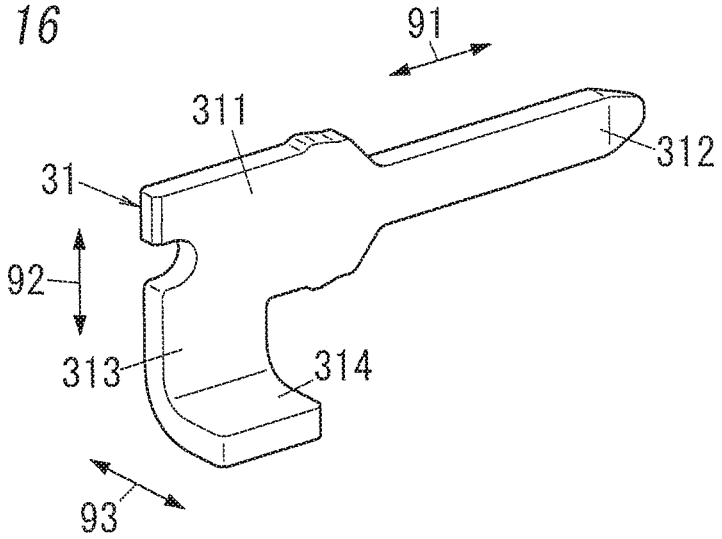
FIG. 16 is a perspective view of a post according to the embodiment.

Each post 31 includes a base portion 311, a contact portion 312 that is provided so as to extend from the base portion 311 in the direction 91, and an extending portion 313 that is provided so as to extend from the base portion 311 in the direction 92, as shown in FIG. 16. Furthermore, each post 31 includes a soldering portion 314 that is provided so as to extend from the extending portion 313 in the direction 93. Specifically, each post 31 integrally includes the base portion 311, the contact portion 312, the extending portion 313, and the soldering portion 314 due to bending processing performed on a sheet metal, for example. The soldering portion 314 is soldered to the board 72 (refer to FIG. 8). When the plug connector 2 is coupled to the receptacle connector 3, the contact portion 312 is interposed between the first contactor 421 and the second contactor 422 of the contact 4, and thus electrical connection therebetween is established.

The housing 32 is constituted by a molded article made of a synthetic resin that is electrically insulated, and is formed in a square tube-like shape in which an insertion opening 33 opens on one surface (rear surface), as shown in FIG. 5. The plug connector 2 is to be inserted into the insertion opening 32.

The connector device 1 according to the present embodiment is configured as described above, and the plug connector 2 is coupled (fitted) to the receptacle connector 3 with the following procedure.

When the housing 5 of the plug connector 2 is inserted into the insertion opening 33 of the housing 32 of the receptacle connector 3, each post 31 is inserted between the first contactor 421 and the second contactor 422 of the corresponding contact 4. As a result of the first contactor 421 and the second contactor 422 coming into contact with the post 31 from two sides in the direction 93, the post 31 is electrically connected to the contact 4 and the core wire 61 of the electrical wire 6 attached to the contact 4 (refer to FIG. 7).

When the housing 5 of the plug connector 2 is inserted to a predetermined position in the insertion opening 33 of the housing 32 of the receptacle connector 3, the lock portion 62*a* of the lever 6*a* is locked to the locked portion (hole) 34 of the housing 32 (refer to FIG. 6). Accordingly, the plug connector 2 and the receptacle connector 3 are kept in a coupled (fitted) state.

Figure 14:
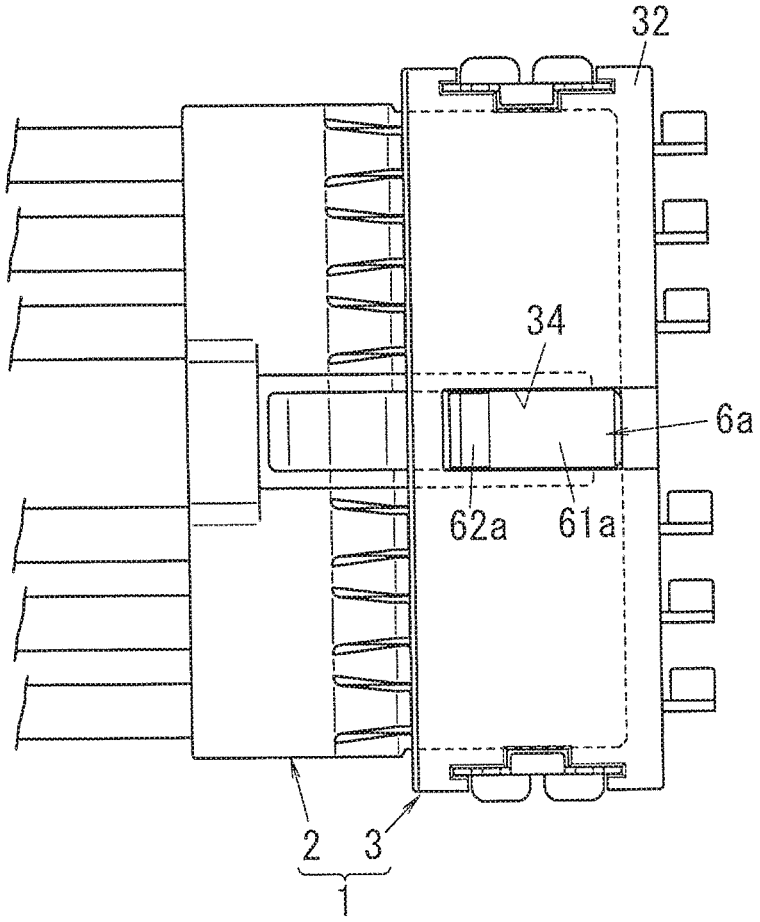
FIG. 14 is a perspective view of the plug connector and the receptacle connector according to the embodiment in a state of normal fitting.
Figure 15:
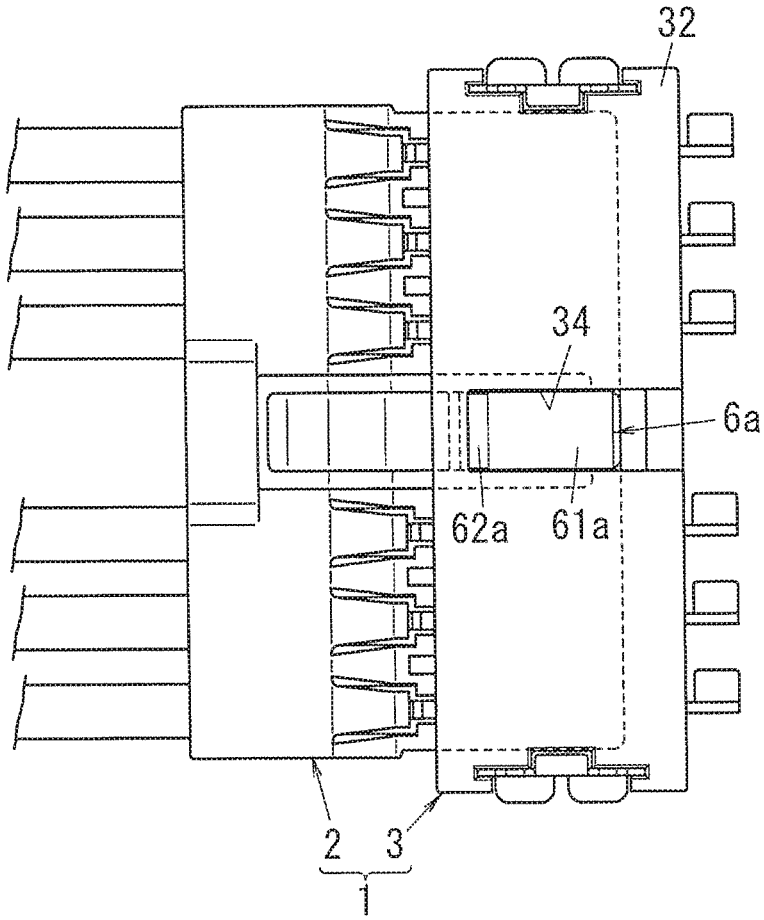
FIG. 15 is a perspective view of the plug connector and the receptacle connector according to the embodiment in a state of half fitting.

Also, since the locked portion 34 is an opening portion, whether or not the lock portion 62*a* of the lever 6*a* has been normally fitted to the locked portion 34 of the housing 32 can be visually confirmed with ease. That is, the plug connector 2 and the receptacle connector 3 in a normal fitted state (refer to FIG. 14) can be visually confirmed with ease. In other words, the occurrence of the plug connector 2 and the receptacle connector 3 being in a half-fitted state (refer to FIG. 15) can be reduced.

Note that the plug connector 2 and the receptacle connector 3 may have different colors from each other. By changing colors of the molded articles in this way, whether or not the plug connector 2 is normally fitted to the receptacle connector 3 can be visually confirmed more easily.

Figure 10:
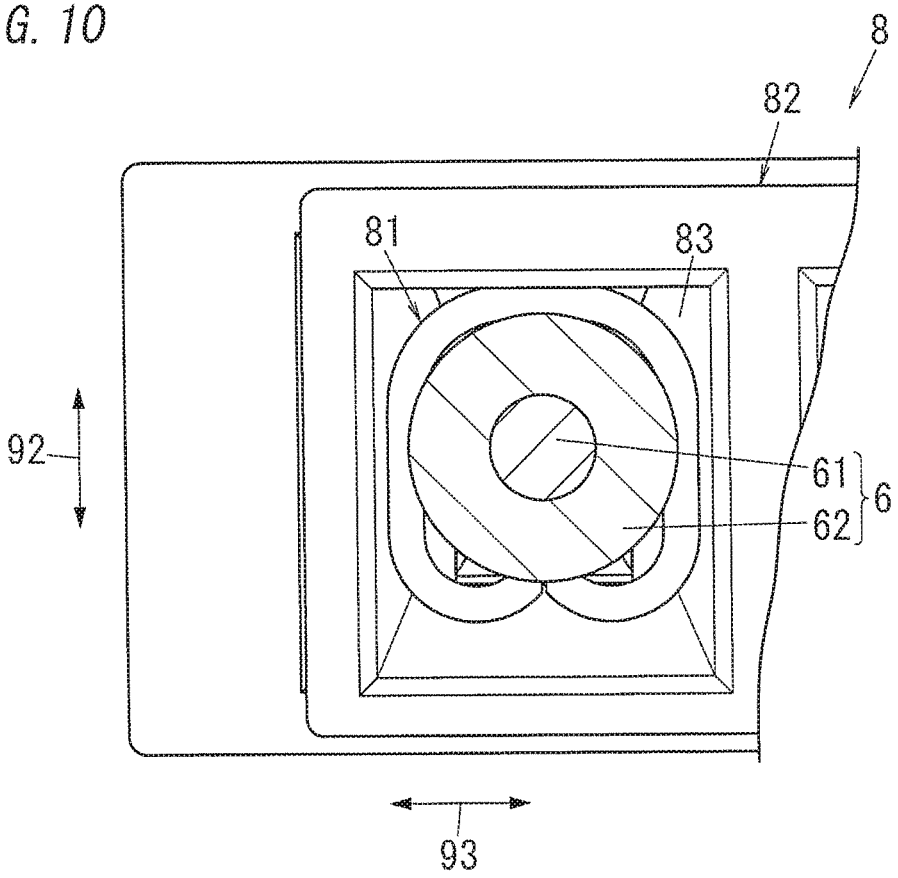
FIG. 10 is a diagram for describing a state in which a contact is housed in a housing in a plug connector of a comparative example.

In such a connector device 1, the extending portions 462 and 463 of the protruding portion 46 of the contact 4 respectively engage with the recesses 531 and 532 of the housing 5, as shown in FIG. 9. Accordingly, even if the electrical wire 6 vibrates, vibration of the contact 4 inside the internal space 51 of the housing 5 can be reduced by the extending portions 462 and 463. On the other hand, in a connector of a comparative example shown in FIG. 10, a contact 81 does not include a protruding portion, and therefore, when the electrical wire 6 vibrates, the contact 81 also largely vibrates inside an internal space 83 of the housing 82. As a result, the contact 4 of the present embodiment can reduce vibration (movement amount) of the contact portion 42 compared with the contact 81 of the comparative example.

Next, releasing of fitting of the plug connector 2 and the receptacle connector 3 will be described. First, when the operation portion 63*a* of the lever 6*a* of the plug connector 2 is pushed down from above in the direction 92, the lock between the lock portion 62*a* and the locked portion 34 is released. In this state, the plug connector 2 can be removed from the receptacle connector 3 in the direction 91.

Note that, when the plug connector 2 is inserted into the receptacle connector 3, operation portion 63*a* may be pushed in the direction 92. In this case, the pushing force on the operation portion 63*a* is released when insertion is complete, and the lock portion 62*a* is locked to the locked portion 34.

Figure 8:
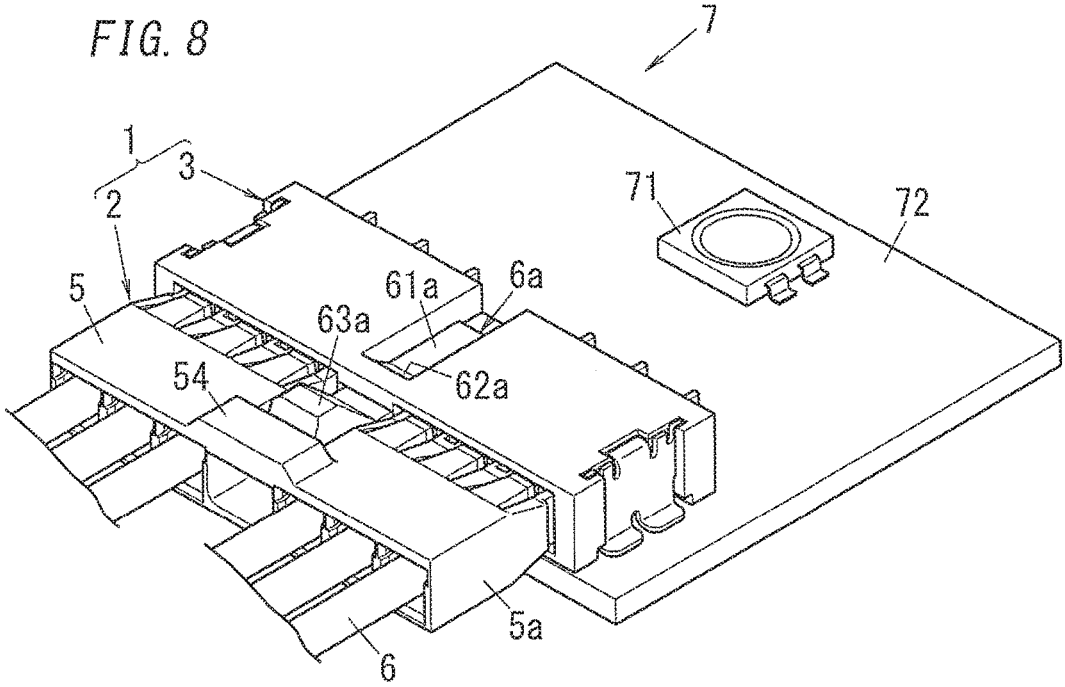
FIG. 8 is a perspective view of the connector device according to the embodiment.

The connector device 1 according to the present embodiment is used in an on-board LED device 7, as shown in FIG. 8, for example. In the example in FIG. 8, the receptacle connector 3 is mounted on the board 72 on which an LED chip 71 is mounted. The LED chip 71 is a surface mount type LED chip (SMD chip), for example. The contacts 4 (refer to FIG. 3) each attached to the electrical wire 6 are inserted into the housing 5 in the plug connector 2. As a result of such a plug connector 2 being connected (fitted) to the receptacle connector 3, the electrical wires 6 and a wiring circuit in the board 72 are electrically connected.

In the plug connector 2 according to the present embodiment described above, the contact 4 includes the protruding portion 46 on the end portion side of the fixing portion 44 opposite to the connection portion 43 in the direction 91, which is the longitudinal direction of the contact 4, so as to protrude therefrom. The protruding portion 46 reduces the amount of movement of the contact 4 inside the internal space 51 of the housing 5 at least in predetermined directions (directions 92 and 93) that intersect the longitudinal direction including a direction orthogonal to the longitudinal direction). Accordingly, in the plug connector 2 according to the present embodiment, since the positional displacement of the contact portion 42 of the contact 4 inside the internal space 51 of the housing 5 can be reduced, wear of the contact portion 42 can be reduced. Specifically, in the case of being mounted on a car in which the connector device 1 is subjected to frequent vibration, wear of the contact portion 42 in the connector device 1 according to the present embodiment can be reduced.

Also, in the plug connector 2 according to the present embodiment, the protruding portion 46 is provided separately from the fixing portion 44, and therefore the protruding portion 46 can be designed (shape, size setting) focusing on vibration suppression.

Furthermore, in the plug connector 2 according to the present embodiment, the extending portions 462 and 463, which form a pair, are each formed in a tapered shape. Accordingly, in the plug connector 2 according to the present embodiment, when the contact 4 is inserted into the housing 5, the pair of extending portions 462 and 463 is unlikely to catch on the housing 5. As a result, although the total length of the contact 4 increases because of the protruding portion 46 in the longitudinal direction (direction 91), the contact 4 can be easily inserted into the housing 5. Specifically, even if clearance is small, the contact 4 can be easily inserted into the housing 5.

Also, in the plug connector 2 according to the present embodiment, the base portion 461 of the protruding portion 46 is provided no as to protrude from the central portion of the fixing portion 44. Accordingly, in the plug connector 2 according to the present embodiment, when the two end portions of the fixing portion 44 are bent so that the fixing portion 44 fixes the covering 62 of the electrical wire 6, the position of the protruding portion 46 does not change, and therefore the influence on the protruding portion 46 caused by the covering 62 being fixed is small.

In the plug connector 2 according to the present embodiment described above, the regulating portion 54 of the housing 5 is provided in the housing body 5*a* so as to be located on the rear side (second side) of the housing body 5*a* relative to the operation portion 63*a* of the lever 6*a* in the direction 91 in which the housing 5 is inserted into the housing 32 (partner housing). Accordingly, the height of the plug connector 2 according to the present embodiment in the direction 92 can be reduced compared with a connector in which a regulating portion is provided above an operation portion in the direction (thickness direction of the housing 5) 92 that is orthogonal to the direction 91. That is, with the plug connector 2 according to the present embodiment, the overall size of the connector can be reduced while protecting the lever 6*a*.

Also, in the plug connector 2 according to the present embodiment, it is difficult to touch the operation portion 63*a* by hand from the rear side (second side) in the direction 91. Accordingly, a half-fitted state that occurs due to a user erroneously pushing the operation portion 63*a* when the plug connector 2 is fitted to the receptacle connector 3 is unlikely to occur.

In the plug connector 2 according to the present embodiment, the lock portion 62*a* is located between the support portion 611*a* and the operation portion 63*a* in the direction 91. Accordingly, in the plug connector 2 according to the present embodiment, locking between the lock portion 62*a* and the locked portion 34 can be performed and released by an operation of the lever 6*a* utilizing the principle of leverage, and as a result locking and releasing locking can be performed with a little force.

Also, in the plug connector 2 according to the present embodiment, the end surface 631*a* of the operation portion 63*a* in the direction (thickness direction of the housing 5) 92 exceeds, in the direction (upward) 92, an end surface 541 of the regulating portion 54 in the direction 92. Accordingly, in the plug connector 2 according to the present embodiment, since the operation portion 63*a* juts out so as to exceed the regulating portion 54, a user can easily operate the operation portion 63.

On the other hand, as the plug connector 2 (refer to FIG. 13) according to another example of the present embodiment, the end surfaces 631*a* and 541 of the operation portion 63*a* and the regulating portion 54 in the direction (thickness direction of the housing 5) 92 may be located on the same plane (on an imaginary plane 94). Accordingly, in the plug connector 2 according to the present embodiment, the protruding portion of the operation portion 63*a* exceeding the regulating portion 54 in the direction 92 can be reduced, and as a result the height in the direction 92 can be further reduced.

Furthermore, in the plug connector 2 according to the present embodiment, the lever 6*a* and the regulating portion 54 are provided side by side with the plurality of internal spaces 51 in the direction 93 in which the plurality of internal spaces 51 are arranged side by side. Accordingly, in the plug connector 2 according to the present embodiment, the thickness in the direction thickness direction of the housing 5) 92 can be reduced compared with a configuration in which the lever 6*a* and the regulating portion 54 are provided side by side with the plurality of internal spaces 51 in the direction 92.

Figure 11:
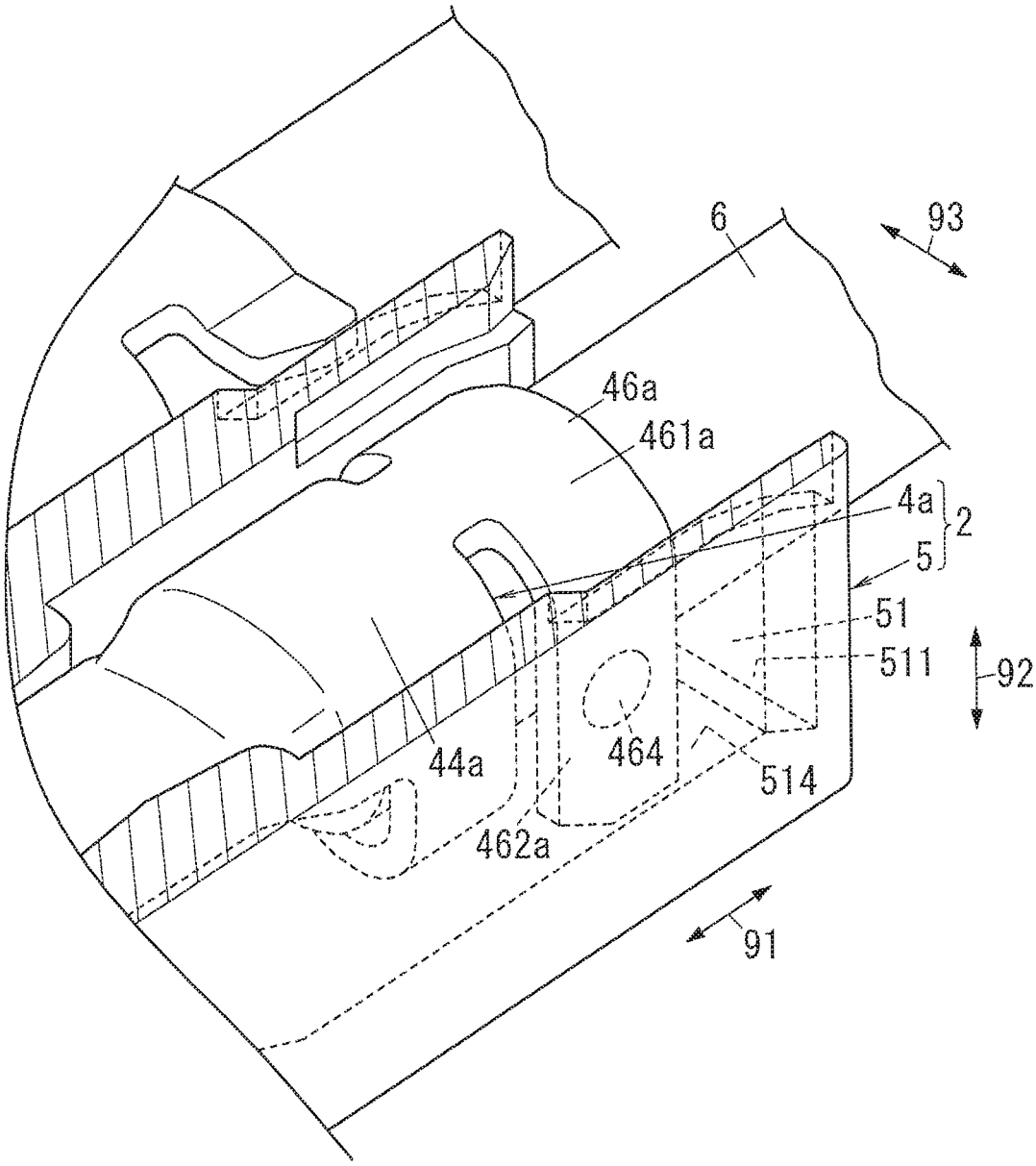
FIG. 11 is a schematic diagram illustrating main portions of a the plug connector according to a modification of the embodiment.
Figure 12:
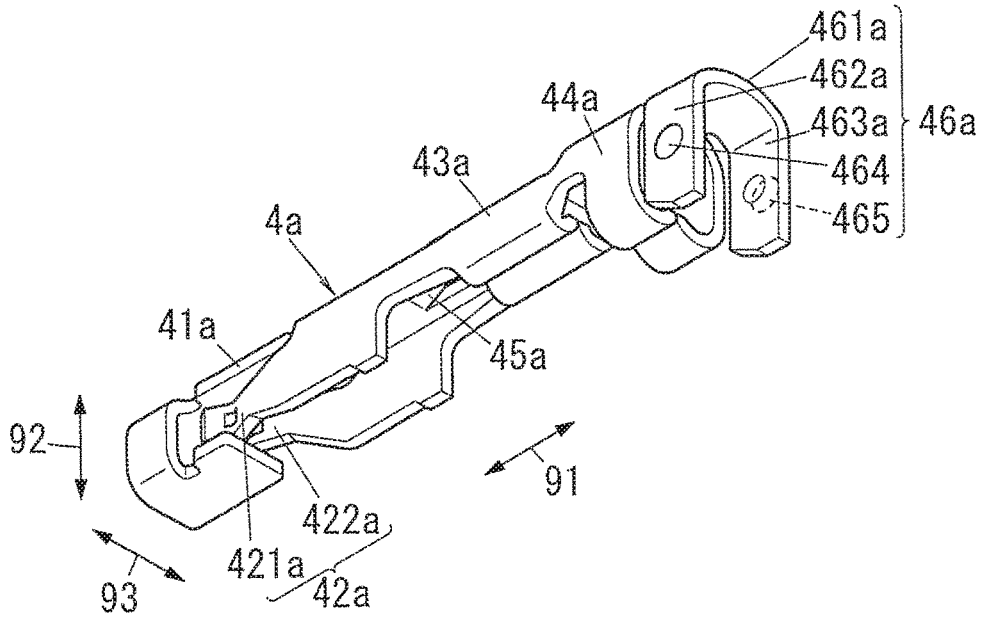
FIG. 12 is a perspective view of the contact according to the modification of the embodiment.

Note that the plug connector 2 may include the contact 4*a* shown in FIGS. 11 and 12 instead of the contact 4. The contact 4*a* will be described with reference to FIGS. 11 and 12. Note that, although FIGS. 11 and 12 show a state of the contact 4*a* when attached to the electrical wire 6, illustration of the electrical wire 6 is omitted in FIG. 12.

The contact 4*a* includes a base portion 41*a*, a contact portion 42*a*, a connection portion 43*a*, a fixing portion 44*a*, a fixing piece 45*a*, and a protruding portion 46*a*, as shown in FIG. 12. Specifically, the contact 4*a* integrally includes the base portion 41*a*, the contact portion 42*a*, the connection portion 43*a*, the fixing portion 44*a*, the fixing piece 45*a*, and the protruding portion 46*a* due to bending processing performed on a sheet metal, for example. The contact 4*a* is, similar to the contact 4, a member to which the electrical wire 6 is attached along the direction 91. Also, the contact portion 42*a* includes a first contactor 421*a* and a second contactor 422*a*. Note that the base portion 41*a*, the contact portion 42*a*, the connection portion 43*a*, the fixing portion 44*a*, and the fixing piece 45*a* respectively have configurations similar to those of the base portion 41, the contact portion 42, the connection portion 43, the fixing portion 44, and the fixing piece 45. Also, the first contactor 421*a* has a configuration similar to that of the first contactor 421, and the second contactor 422*a* has a configuration similar to that of the second contactor 427.

The protruding portion 46*a* is provided on a side opposite to the connection portion 43*a* relative to the fixing portion 44*a* in the direction 91 of the contact 4*a*. The protruding portion 46*a* integrally includes a base portion 461*a*, a pair of extending portions 462*a* and 463*a*, and a pair of projection portions 464 and 465. Note that the base portion 461*a* has substantially the same shape as the base portion 461.

The pair of extending portions 462*a* and 463*a* is formed such that tips thereof oppose each other. That is, the pair of extending portions 462*a* and 463*a* is provided so as to extend from the base portion 461*a* in the direction 92.

The projection portions 464 and 465 are respectively provided on outer surfaces of the pair of extending portions 462*a* and 463*a*.

When such a contact 4*a* is inserted into the housing 5, the base portion 461*a* of the protruding portion 46*a* of the contact 4*a* comes into contact with the upper surface 513 (refer to FIG. 9) of the internal space 51, and the tips of the pair of extending portions 462*a* and 463*a* come into contact with a lower surface 514 of the internal space 51, as shown in FIG. 11. Accordingly, even when the electrical wire 6 vibrates in the direction 92, the amount of movement of the contact 4 in the direction 92 is reduced by the base portion 461*a* and the extending portions 462*a* and 463*a*. Also, the projection portions 464 and 465, which form a pair, respectively come into contact with the side surfaces 511 and 512 of the internal space 51. Accordingly, even when the electrical wire 6 vibrates in the direction 93, the amount of movement of the contact 4 in the direction 93 is reduced by the projection portions 464 and 465. As a result, the positional displacement of the contact portion 42*a* of the contact 4*a* shown in FIG. 11 can be reduced compared with the contact 81 (refer to FIG. 10) of the comparative example.

Figure 17:
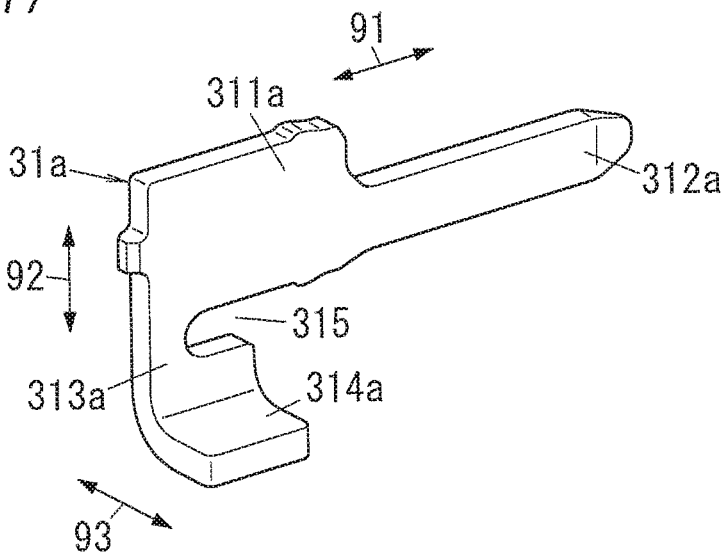
FIG. 17 is a perspective view of a post according to another example of the embodiment.

Note that the receptacle connector 3 may include a plurality of posts 31*a* instead of the plurality of posts 31 as the electrically conductive member. Each post 31*a* includes a base portion 311*a*, a contact portion 312*a*, an extending portion 313*a*, and a soldering portion 314*a*, as shown in FIG. 17. Specifically, each post 31*a* integrally includes the base portion 311*a*, the contact portion 312*a*, the extending portion 313*a*, and the soldering portion 314*a* due to bending processing performed on a sheet metal, for example. Furthermore, a recess 315 is formed in each post 31*a*. That is, the recess 315 is formed in the extending portion 313*a* along the direction 91. The extending portion 313*a* has a configuration similar to that of the extending portion 313 except for that described above. The base portion 311*a*, the contact portion 312*a*, and the soldering portion 314*a* respectively have configurations similar to those of the base portion 311, the contact portion 312, and the soldering portion 314. Note that, in the receptacle connector 3, at least one of the plurality of posts 31 may be replaced by the post 31*a* instead of replacing all the plurality of posts 31.

As a result of forming the recess 315 in the post 31*a*, as shown in FIG. 17, the post 31*a* can have flexibility. Accordingly, in an application in which the connector device is exposed to a large thermal shock due to LED lighting in such a case of an on-board LED device 7 such as an LED head lamp, for example, the stress applied to the soldering portion 314*a* of the post 31*a* due to the thermal expansion and contraction difference between the board 72 (refer to FIG. 8) and the receptacle connector 3 (refer to FIG. 8) (in particular, in a direction in which the plurality of posts 31*a* are arranged side by side) can be reduced. As a result, resistance to a solder crack in the soldering portion 314*a* can be improved.

Note that the locking configuration is not limited to the configuration in which the lock portion 62*a* of the plug connector 2 is a projection portion provided so as to protrude from the lever body 61*a*, and the locked portion 34 of the receptacle connector 3 is a hole, and the lock portion 62*a* may be a hole and the locked portion 34 may be a projection portion.

While the invention has been described with respect to some of the preferred embodiments, it will be understood that various changes and modifications may be made by those skilled in the art without departing from the spirit and scope of the invention as defined in the following claims.

The invention claimed is:

1. A connector comprising:

a contact in an elongated shape that is electrically conductive and is attached to an electrical wire; and a housing that has an internal space for housing the contact is formed, the electrical wire including:

a core wire that is electrically conductive, and a covering that is electrically insulated and covers the core wire, the contact including:

a contact portion that is to be electrically connected to an electrically conductive member when the contact is housed in the housing, a connection portion that is electrically connected to the core wire of the electrical wire, a fixing portion that is provided on a side opposite to the contact portion relative to the connection portion in a longitudinal direction of the contact, and fixes the covering of the electrical wire, and a protruding portion that is provided on a side on which an end portion of the fixing portion opposite to the connection portion in the longitudinal direction is located so as to protrude, a distance between ends of the protruding portion is longer than a distance between ends of the fixing portion in a predetermined direction that intersects the longitudinal direction, the protruding portion being configured to reduce an amount of movement of the contact inside the internal space in at least the predetermined direction.

2. The connector according to claim 1, wherein the protruding portion includes a base portion that is provided in the end portion of the fixing portion toward a side opposite to the connection portion in the longitudinal direction, and two extending portions that are respectively provided on two sides of the base portion so as to extend in a direction that intersects the longitudinal direction, the two sides being along the longitudinal direction.

3. The connector according to claim 2, wherein two inner surfaces of the internal space respectively have two recesses to which the two extending portions are respectively introduced when the contact is housed in the housing.

4. The connector according to claim 2, wherein the two extending portions have two tips that oppose each other.

5. The connector according to claim 4, wherein the protruding portion further includes projection portions respectively provided on outer surfaces of the two extending portions.

6. The connector according to claim 2, wherein the two extending portions have tips that are brought into contact with an inner surface of the internal space.

7. The connector according to claim 3, wherein each of the two extending portions is formed in a tapered shape such that a length from the base portion to a tip decreases toward the fixing portion on a side on which the fixing portion is located in the longitudinal direction.

8. The connector according to claim 2, wherein the base portion is formed such that a shape of a cross section whose normal direction in the longitudinal direction is arc-like.

9. The connector according to claim 8, wherein the shape of the cross section of the base portion is arc-like along an outer periphery of the electrical wire.

10. The connector according to claim 2, wherein the base portion is provided so as to protrude from a central portion of the fixing portion in the longitudinal direction.

11. A connector device comprising:

the connector according to claim 1; and a receptacle connector that includes the electrically conductive member and to which the connector is to be coupled.

12. The connector according to claim 1, further comprising a lever in the housing, wherein the housing is configured so as to be inserted into a partner housing of a partner member that is to be fitted to the connector from a first side in a first direction, the lever is provided in the housing along the first direction, the lever includes a lever body that includes a support portion fixed to the housing and is configured to be bendable along a second direction that is orthogonal to the first direction, a lock portion that is provided in the lever body and is configured to be lockable to a locked portion of the partner housing when the housing is inserted into the partner housing, and an operation portion that is provided on an outer surface of the lever body and accepts an operation for releasing locking between the lock portion and the locked portion, the housing includes a housing body, and a regulating portion that is provided on an outer surface of the housing body and regulates the operation performed on the operation portion, and the regulating portion is provided in the housing body so as to be located closer to a second side, opposite to the first side, than the operation portion in the first direction.

13. A connector to be fitted to a partner member, the connector comprising:

a housing configured to be inserted into a partner housing of the partner member from a first side in a first direction; and a lever that is provided in the housing along the first direction, the lever including a lever body that includes a support portion fixed to the housing and is configured to be bendable along a second direction that is orthogonal to the first direction, a lock portion that is provided in the lever body and is configured to be lockable to a locked portion of the partner housing when the housing is inserted into the partner housing, and an operation portion that is provided on an outer surface of the lever body and accepts an operation for releasing locking between the lock portion and the locked portion, the housing including a housing body, and a regulating portion that is provided on an outer surface of the housing body and regulates the operation to be performed on the operation portion, and the regulating portion is provided on the housing body so as to be located closer to a second side, opposite to the first side, than the operation portion in the first direction.

14. The connector according to claim 13, wherein the operation portion is located closer to the second side than the support portion in the first direction, and the lock portion is located between the support portion and the operation portion in the first direction.

15. The connector according to claim 13, wherein the lock portion is provided so as to protrude from the lever body in the second direction, and the regulating portion protrudes from the outer surface of the housing body in the second direction.

16. The connector according to claim 15, wherein an end surface of the operation portion in the second direction is located so as to exceed, in the second direction, an end surface of the regulating portion in the second direction.

17. The connector according to claim 15, wherein the end surface of the operation portion in the second direction and the end surface of the regulating portion in the second direction are located on a same plane.

18. The connector according to claim 16, wherein the regulating portion is longer than the operation portion in a third direction that is orthogonal to the first direction and the second direction.

19. The connector according to claim 13, further comprising a plurality of contacts that are electrically conductive and are each attached to an electrical wire, wherein the housing body has a plurality of contact insertion holes to which the plurality of contacts are respectively inserted, the plurality of contact insertion holes being provided in the housing body side by side in a third direction that is orthogonal to the first direction and the second direction, and the lever and the regulating portion are provided side by side with the plurality of contact insertion holes in the third direction.

20. A connector device comprising:

the connector according to claim 13; and the partner member to which the connector is to be fitted.

* * * * *